US006315126B1

(12) United States Patent
Cornelissen

(10) Patent No.: US 6,315,126 B1
(45) Date of Patent: Nov. 13, 2001

(54) TRAY

(75) Inventor: Arthur Cornelissen, Blankenberge (BE)

(73) Assignee: De Ster Holding B.V., Amsterdam (NL)

( * ) Notice: Subject to any disclaimer, the term of this patent is extended or adjusted under 35 U.S.C. 154(b) by 0 days.

(21) Appl. No.: 09/456,942

(22) Filed: Dec. 7, 1999

Related U.S. Application Data

(63) Continuation of application No. PCT/EP98/03323, filed on Jun. 4, 1998.

(30) Foreign Application Priority Data

Jun. 9, 1997 (DE) ..... 197 24 309

(51) Int. Cl.[7] ..... B65D 6/04

(52) U.S. Cl. ..... 206/564; 604/541; 220/23.4; 220/556

(58) Field of Search ..... 206/557, 558, 206/561, 564, 541, 545; 426/120; 220/575, 521, 555, 556, 23.4; 414/403; 229/125.01, 125.12

(56) References Cited

U.S. PATENT DOCUMENTS

| | | |
|---|---|---|
| D. 405,646 | 2/1999 | Indekeu . |
| D. 405,648 | 2/1999 | Indekeu . |
| D. 407,948 | 4/1999 | Indekeu . |
| D. 409,449 | 5/1999 | Cornelissen . |

(List continued on next page.)

FOREIGN PATENT DOCUMENTS

| | | |
|---|---|---|
| 178 704 | 6/1954 | (AT) . |
| 179 861 | 10/1954 | (AT) . |
| 2 120 473 | 5/1972 | (DE) . |
| 25 01 427 | 7/1975 | (DE) . |
| 75 23 349 | 7/1975 | (DE) . |
| 90 02 925 | 5/1990 | (DE) . |
| 94 13 334 | 8/1994 | (DE) . |
| 1546 | 3/1909 | (GB) . |

OTHER PUBLICATIONS

European Office Action/Communication in accordance with Article 96(2) EPÜ (for European Application No. 98 937 443.4, dated Jan. 22, 2001) 3 pages.

Notification of Transmittal of Copies of Translation of the International Preliminary Examination Report dated Oct. 29, 1999 (5 pages).

Mitteilung Über die Übermittlung des Internationalen Recherchenberichts Oder Erklärung dated Dec. 3, 1998 (3 pages).

Internationaler Recherchenbericht dated Dec. 4, 1998 (5 pages).

* cited by examiner

*Primary Examiner*—Luan K. Bui
(74) *Attorney, Agent, or Firm*—Shlesinger, Arkwright & Garvey LLP

(57) ABSTRACT

Tray is engineered for receiving food, in particular on board aeroplanes, vehicles or other transport means, wherein the tray comprises a tray body, on which a first receiving surface for receiving food is formed, and a receiving part extending above the first receiving surface and spaced therefrom, on which upper side of which a second receiving surface for receiving food extending above the first receiving surface and spaced therefrom. Since the receiving surfaces are disposed on different planes, the actual area of the tray may be slight, in which case the receiving surfaces disposed lying above one another together form a receiving surface which may be substantially larger than the area of the tray. The tray is therefore particularly suitable for use in restricted spatial conditions, for example on board aeroplanes. The vertical dimensions of the tray may be such that the tray body with the receiving part placed thereon fits into a slide-in unit of an existing trolley. This saves space, for example on board aeroplanes.

29 Claims, 10 Drawing Sheets

U.S. PATENT DOCUMENTS

| | | | | |
|---|---|---|---|---|
| 1,669,065 | | 5/1928 | Minton, Jr. . | |
| 1,683,603 | * | 9/1928 | Canfield | 206/541 |
| 2,490,269 | | 12/1949 | Johnson . | |
| 2,709,904 | * | 6/1955 | Boughton | 220/575 |
| 2,944,694 | * | 7/1960 | Kinsey | 206/541 |
| 3,608,770 | * | 9/1971 | Naimoli | 206/545 |
| 4,190,191 | | 2/1980 | Forbes, Jr. . | |
| 4,202,460 | * | 5/1980 | Imbeault | 220/23.4 |
| 4,360,148 | | 11/1982 | Forbes, Jr. . | |
| 4,406,368 | * | 9/1983 | Hermes | 220/23.4 |
| 4,489,971 | | 12/1984 | Martinez . | |
| 4,776,485 | * | 10/1988 | Brennan | 206/564 |
| 4,947,985 | | 8/1990 | Crabtree et al. . | |
| 5,082,115 | * | 1/1992 | Hutcheson | 206/545 |
| 5,368,183 | * | 11/1994 | Singer | 206/541 |
| 5,624,051 | * | 4/1997 | Ahern, Jr. et al. | 220/556 |

TRAY

CROSS REFERENCE TO RELATED APPLICATION

This application is a continuation of application no. PCT/EP98/03323, filed Jun. 4, 1998, which claims the priority of German application no. 197 24 302.9, filed Jun. 9, 1997, and each of which is incorporated herein by reference.

FIELD OF THE INVENTION

The invention relates to a tray of the type having a tray body including a first food receiving surface, a receiving part spaced above the first receiving surface, and a second food receiving surface on the top side of the receiving part, the tray being particularly suited for use on board aeroplanes, vehicles or other transport means.

BACKGROUND OF THE INVENTION

Such trays are generally known. They comprise a receiving surface for receiving food, wherein the food, for example on board aeroplanes, may be contained in meal containers, bowls, beakers, cups or the like, which when the tray is used, for example when serving meals with the tray, stand on the receiving surface.

When catering for travellers, in particular on board aeroplanes, it is frequently necessary to serve with the tray a complete meal, the constituents of which (starter, main course, dessert) are contained in several meal containers, so that the receiving surface of the tray has to have a correspondingly large design. This particularly applies when drinks are also to be served at the same time as the meal with the tray. In the case of trays having large receiving surfaces, problems frequently occur on account of the restricted spatial conditions especially on board aeroplanes, for example, if passengers sitting next to one another bump against one another with their trays. There is then the danger that beakers or cups standing on the tray are knocked over and their contents spilt.

In the case of smaller trays having correspondingly smaller receiving surfaces, problems are caused by the fact that the meal containers and the like stand tightly packed on the tray, which makes their handling difficult, for example when opening. Moreover no storage surface, for example for lids removed from meal containers, is available on such trays.

A tray of the pertinent kind is known from the U.S. Pat. No. 1,669,065 and consists of a tray body subtending a first food receiving surface and of a receiving section above and spaced from said first receiving surface, a second food receiving surface being present in the top side of said receiving section.

The receiving section of this known tray is connected in collapsible manner by a folding mechanism to the tray body.

This known tray incurs the drawback that the collapsible linkage of receiving section and tray body renders manufacture complex and hence costly. The known tray incurs a further drawback of limited versatility in use because the receiving section in its operative position always assumes the position relative to the tray body on account of the folding linkage between receiving section and tablet body.

The German patent document A 25 01 427 describes a stackable container and serving tray wherein each serving board offers only one receiving surface. This known tray therefore is poorly applicable to constricted spaces.

A serving tray is known from the German patent document A 21 20 473 which also comprises only one receiving surface and hence is poorly suited for constricted spaces.

The German patent document U 90 02 925.9 describes a plastic multi-way packaging means consisting of a rectangular menu dish with removable cover.

The objective of the invention is to create a tray of the pertinent kind that shall be free of the above cited drawbacks, which therefore shall also be appropriate in constricted spaces, which shall be simple and hence economical to manufacture and which shall be versatile.

This object is achieved by the teaching set forth herein. For example, this object is achieved by the tray according to the invention that includes a tray body having a first food receiving surface, a receiving part spaced above the first food receiving surface, and a second food receiving surface on the top side of the receiving part; that receiving part being configured for being placed on the tray body and being detachably or displaceably connected to the tray body The basic idea of the teaching specified by the invention lies in arranging receiving surfaces above one another on different planes one above the other so that the actual area of the tray may be small, but the receiving surfaces arranged on planes lying one above the other together form a receiving surface which may be substantially larger than the area.

In this manner spatial problems are avoided, and the handling of the tray is improved.

The tray may have such dimensions with respect to its height that it fits into slide-in compartments of existing trolleys. Consequently special trolleys are not required for the tray specified by the invention.

On account of the receiving surfaces disposed above one another, the area of the tray specified by the invention may be reduced in comparison with conventional trays, without the receiving surface which overall is available being reduced. However with a reduced area a larger number of trays specified by the invention fits into a slide-in compartment of a trolley when compared with conventional trays. Consequently considerable space is saved by saving trolleys when compared with conventional trays, for example on board aeroplanes. By the reduced spatial requirement for the food, it is possible to install additional rows of seats in aeroplanes, or with the same number of rows of seats to increase the spacing between the rows of seats, which saves costs or respectively ensures greater comfort for the passengers.

The receiving part may be securely connected to the tray body, for example moulded in one piece with the tray body. However an advantageous further development of the teaching according to the invention specifies that the receiving part is detachably or movably connected to the tray body. In this embodiment the receiving part may for example be removable, so that after the removal of the receiving part access to meal containers or the like disposed on the first receiving surface is facilitated.

In the above-mentioned embodiment the receiving part is expediently constructed as an attachment placed on the tray body.

In the embodiments with the detachable receiving part, the receiving part expediently comprises an edge from which at opposite sides of the receiving part edge parts extend, which protrude over the underside of the receiving part and with which the receiving part is supported on the tray body. Since the edge parts may be moulded in one piece with the edge of the receiving part, this embodiment is simple and inexpensive to produce. It also has a robust construction.

A particularly advantageous further development of the embodiment with the detachable receiving part specifies that the receiving part is disposed displaceable on the tray body in such a manner that, with the displacement of the receiving part, the second receiving surface moves substantially parallel to the first receiving surface. In this embodiment the user may displace the receiving part to one or the other side into different positions, so that access to meal containers or the like standing on the first receiving surface of the tray body is facilitated.

An expedient further development of the embodiment with the displaceable receiving part specifies that on opposite sides the tray body is provided with grooves extending in the direction of displacement of the receiving part and that the edge parts engage in the grooves by ends shaped substantially to complement the grooves. This embodiment is simple and inexpensive to produce and guarantees a secure retention of the receiving part on the tray body transversely to the direction of displacement. However the receiving part may engage in the grooves by projections extending towards the tray body instead of by the edge parts.

The edge parts expediently extend in the direction of displacement substantially over the entire extent of the receiving part. In this manner the stability of the receiving part and its retention on the tray body transversally to the displacement direction is further improved.

A further development of the embodiment with the grooves specifies that on at least two opposite sides the tray is provided with handles, on the upper side of which the grooves are formed. With this embodiment production is facilitated, because the grooves do not have to be constructed on the tray body, but may be formed in the handles, which during the production of the tray are added to the tray body or are pushed onto a tray edge. However the handles may also be moulded in one piece with the tray body, especially by injection moulding. Moreover the grooves may also be formed between the handle and a part of the tray body.

Another further development of the teaching according to the invention specifies that the second receiving surface formed on the receiving part is smaller than the first receiving surface. In this embodiment the receiving part covers only a part of the first receiving surface in the plan view so that the uncovered part of the first receiving surface is accessible from above. In this manner the handling of meal containers or the like standing on the first receiving surface is facilitated.

In the above-mentioned embodiment the second receiving surface may be roughly half the size of the first receiving surface.

In accordance with another further development of the teaching specified by the invention, the tray and/or the receiving part comprises an edge extending upwardly from the respective receiving surface. In this embodiment objects disposed on the receiving surface are prevented from slipping off the side.

The first receiving surface and/or the second receiving surface may be provided with shaped portions, especially depressions, which limit standing surfaces, which correspond at least partially to the outer contour of the bottom of meal containers, bowls , beakers, cups or the like to be placed on the tray. The retention of these objects on the receiving surface is improved thereby.

The shape and size of the tray may be chosen within wide limits, and the tray may be made from various materials. However the tray body and/or the receiving part is expediently made from plastics, so that the tray specified by the invention can be produced simply and inexpensively. The tray body and/or the receiving part are preferably made from transparent plastics, so that objects disposed on the first receiving surface can be seen through the receiving part beneath the receiving part.

According to a further development of the teaching specified by the invention, the tray comprises connecting means for the detachable connection of the tray to at least one adjacent tray. In this embodiment a detachable series connection of adjacent trays is formed, which is advantageous, for example, when the trays are disposed one behind the other in a trolley and are to be removed one after the other from the trolley. The front tray in the removal direction then entrains the next following tray in the removal direction so that the trays may be comfortably removed one after the other.

A further development of the embodiment with the connecting means specifies that the connecting means are formed by a first connecting element which is disposed laterally on the tray and comprises a groove extending substantially parallel to the side of the tray, and by a second connecting element which is disposed at the side of the tray opposite the first connecting element and comprises a protuberance for form-fit engagement in a groove of a first connecting element of an adjacent tray. This embodiment is simple, inexpensive to produce and operationally safe.

In this case the connecting elements may be disposed on the tray body and/or on the receiving part.

A further development of the embodiment with the connecting elements specifies that the free ends of the connecting elements are constructed as hooks, with the hook of the first connecting element pointing downwards and the hook of the second connecting element pointing upwards in such a manner that the first connecting element of a tray can be hooked on the second connecting element of an adjacent tray. In this embodiment a secure connection of adjacent trays is formed, which can be released by lifting one of the trays and unhooking the first connecting element from the second connecting element of the adjacent tray.

The shape, size and cross-section of the connecting elements can be selected within wide limits. However a particularly advantageous further development of the embodiment with the connecting elements specifies that the first and/or the second connecting element has or have a substantially arrow-shaped cross section, the arrow point of which points away from the tray. One advantage of this embodiment in comparison with the above-mentioned embodiment lies in that the first and second connecting elements of a tray can be connected both to the first connecting elements and also to the second connecting elements of an adjacent tray, whereas with the above-mentioned embodiment it is only possible to connect adjacent trays if a first connecting element of a tray with its downwardly pointing hook lies opposite a second connecting element of an adjacent tray with its upwardly pointing hook.

According to an expedient further development of the embodiment with the connecting elements with the connecting elements having the substantially arrow-shaped cross section, the cross section of the connecting elements increases outwardly along the side of the tray. The connecting elements may, for example, be constructed in such a manner that their cross section increases to the side both upwardly and downwardly along the side of the tray on which the respective connecting element is disposed. If, for example, the connecting element is disposed on a narrow side, then its cross section can increase along the narrow side to the adjacent longitudinal side, for example in such a manner that the area of the arrow point of the arrow-shaped cross section increases. In this manner the hooking of the trays onto one another is facilitated.

The connecting elements may be placed on the tray body and/or the receiving part. In accordance with an expedient further development, the connecting elements are however moulded on the tray body and/or the receiving part. This embodiment can be produced simply and inexpensively.

An advantageous further development of the embodiment with the grooves specifies that in the region of their ends the grooves comprise a stop to limit the displacement of the receiving part in relation to the tray body. In this embodiment the edge parts of the receiving part are prevented from moving out of the grooves in the displacement direction, so that an unwanted detachment of the receiving part from the tray body is avoided.

In this case the stop is expediently formed by the connecting element, so that a separate component is not necessary.

In the embodiment with the edge parts, they may expediently comprise an outwardly pointing edge region in the region of their free ends. If the receiving part is used separately, i.e. without the tray body, the receiving part may be supported by these edge part for example on an edge bead of a table top of a passenger table in an aeroplane.

In the embodiments with the detachable receiving part clamping means may be provided for the connection of the receiving part to the tray body by clamping. An undesired detachment of the receiving part from the tray body is prevented by these clamping means.

The clamping means are in this case expediently formed by at least one clamp, which in the clamping position engages to clamp over the edge of the tray body and the edge region of the edge parts of the receiving part. In this embodiment, when the clamp is clamped on, the receiving part is securely connected to the tray body and after the removal of the clamp can be detached from the tray body.

The clamp may be constructed as a separate part. An advantageous further development however specifies that the clamp is moulded on the edge of the tray body or the edge region of the edge parts of the receiving part. In this embodiment production is simplified, since a separate part is no longer necessary for the clamp.

Another further development of the teaching according to the invention specifies that in the region of its edge the tray body is preferably provided with support parts which protrude over the underside of the tray body. In this embodiment the tray may be housed suspended in a trolley or be supported by the support parts in a compartment of the trolley.

The tray specified by the invention may also comprise more than two planes disposed one over the other, on which receiving surfaces are situated.

The invention is described in further detail below by means of the attached drawings in which exemplified embodiments are represented.

DETAILED DESCRIPTION OF THE INVENTION

Identical or corresponding components are provided with the same reference numbers in the figures of the drawings.

Figure 1:
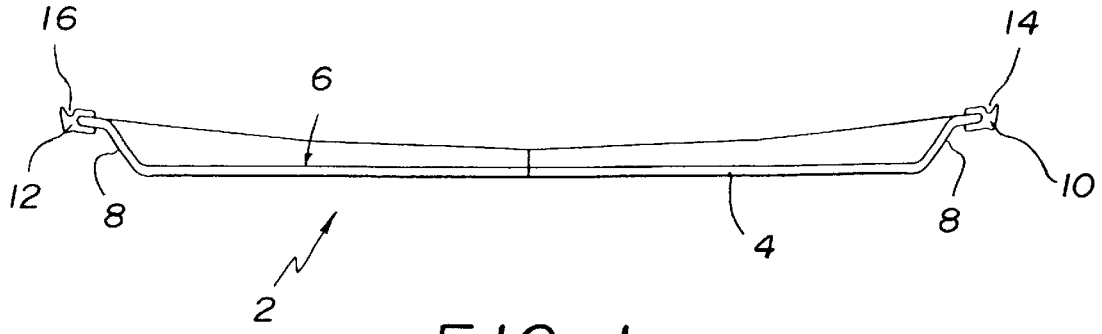
FIG. 1 shows in a diagrammatical side view a first exemplified embodiment of the tray specified by the invention without the receiving part.

Represented in FIG. 1 is a tray 2, which comprises a flat tray body 4 made of plastics, on the upper side of which a first receiving surface 6 is formed. The tray 2 comprises an edge 8 extending upwardly and outwardly from the tray body 4. The edge 8 may extend over the entire periphery of the tray; however it may also be formed on just two opposite sides of the tray 2. Attached to the edge 8 at two opposite sides of the tray 2 are flat handles 10, 12, which at their upper sides are provided in each case with a groove 14 or 16 respectively open at the top.

Figure 2:
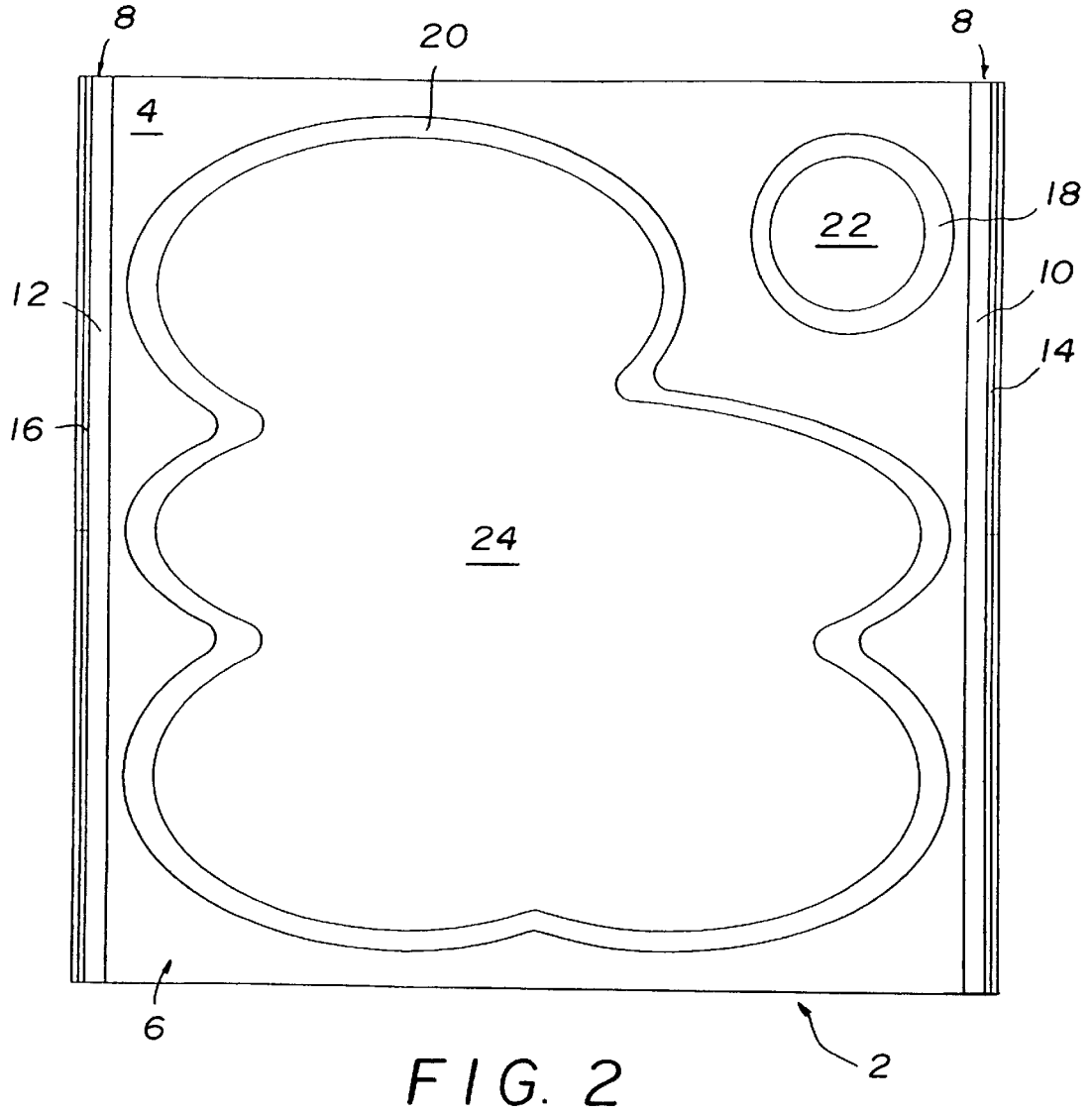
FIG. 2 shows a top plan view in FIG. 1 of the tray shown in FIG. 1.

From FIG. 2 it can be seen that the tray body 4 has a substantially rectangular construction. Furthermore it can be seen that the edge 8 extends substantially over the entire length of the sides at which the handles 10, 12 are provided, with the grooves 14, 16 extending over the entire length of the handles 10, 12. Moreover it can be seen from FIG. 2 that on the first receiving surface 6 the tray 2 comprises shaped portions 18, 20 , which in this exemplified embodiment are formed by depressions in the first receiving surface 6 of the tray body 4 and limit standing surfaces 22, 24, which is adapted to the outer contour of the bottom of meal containers, bowls, beakers, cups or the like in which the food is contained.

Figure 3:
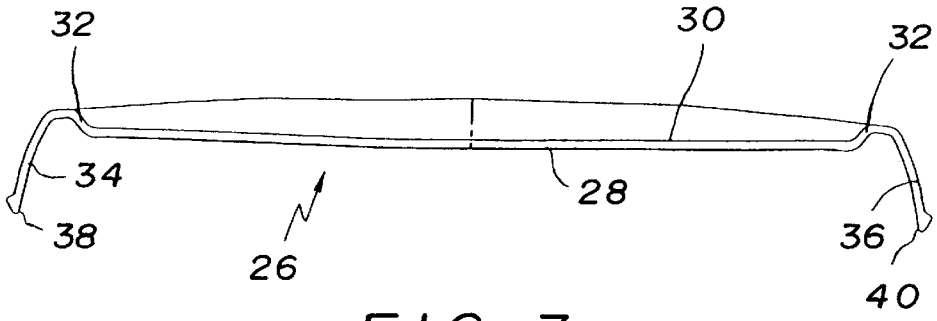
FIG. 3 shows in a diagrammatical side view a receiving part of the tray shown in FIG. 1.

Represented in FIG. 3 is a receiving part 26, which comprises a flat body 28 made from plastics. Formed on the upper side of the body 28 is a second receiving surface 30, and from the body 28 an edge 32 extends upwardly and outwardly, whereby the edge may extend over the entire periphery of the body 28 of the receiving part 26 in its edge region or may be formed just on two opposite sides of the body 28. Moreover at opposite sides the receiving part 26 comprises edge parts 34, 36 extending downwardly from the edge 32, the ends 38, 40 of which are shaped to be substantially complementary to the grooves 14, 16 of the tray body 4.

Figure 4:
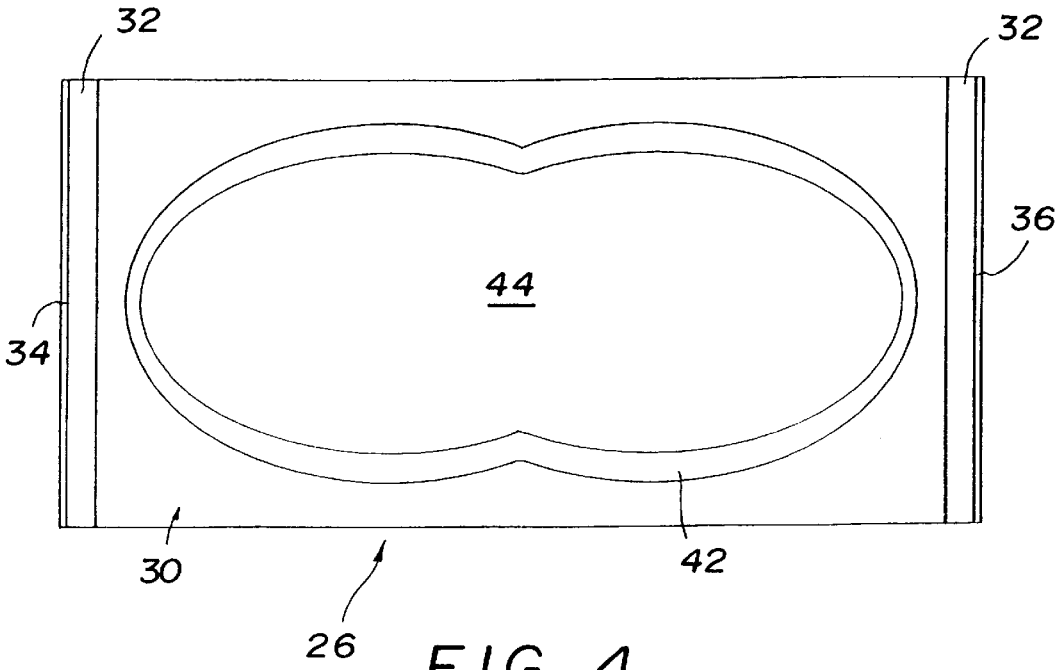
FIG. 4 shows a top plan view in FIG. 3 of the receiving part shown in FIG. 3.

From FIG. 4 it can be seen that the edge 32 extends substantially over the entire extent of the longitudinal sides of the receiving part 26 and that the edge parts 34, 36 also extend substantially over the entire extent of the sides of the receiving part 26. Moreover it can be seen from FIG. 4 that the receiving part 26 comprises a shaped portion 42, which limits a standing surface 44 which is adapted to the outer contour of the base of meal containers or the like.

From a comparison of FIGS. 2 and 4 it can be seen that the second receiving surface 30 is only roughly half the size of the first receiving surface 6 of the tray 2.

The receiving part 26 is constructed as an attachment to the top of the tray body 4.

Figure 5:
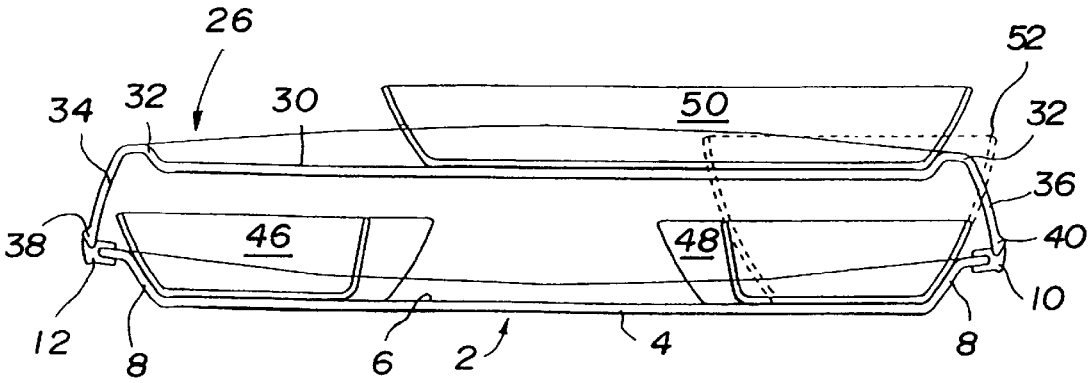
FIG. 5 shows in a partially sectional side view the tray shown in FIG. 1 with the addition of the receiving part shown in FIG. 3 and meal containers placed on the tray.

In FIG. 5 the tray 2 is represented with the receiving part 26 placed on top of it. In this position the receiving part 26 engages by the ends 38, 40 of its edge parts 34, 36 into the grooves 14, 16 of the tray and can be displaced in relation thereto in the groove direction, i.e. in the longitudinal direction of the tray 2. In the arrangement shown in FIG. 5, meal containers 46, 48 are placed on the first receiving surface 6 of the tray 2 and a meal container 50 is placed on the second receiving surface 30. The clear width between the underside of the receiving part 26 and the first receiving surface 6 has such dimensions that the meal containers 46, 48, where appropriate with lids, are situated in the space formed between the receiving part 26 and the first receiving surface 6, without bumping from below against the receiving part 26. In this manner the meal containers 46, 48 remain in their position, even with a displacement of the receiving part 26 relative to the tray body 4.

By virtue of the fact that the receiving surfaces 6, 30 are disposed above one another in different planes, even if the area of the tray 2 is small there is sufficient space available for meal containers or the like on the other receiving surfaces 6, 30.

The tray 2 has such height dimensions that the tray body 4 with the receiving part 26 placed thereon fits into a slide-in unit of a trolley. For this purpose it may only be necessary to store the meal container 50 separately and only after removing the tray 2 from the trolley to place it on the second receiving surface.

The receiving part 26 may for example be placed onto the tray body 4 in such a manner that it is located over the one half of the tray body 4, so that objects having a height which is greater than the clear width between the underside of the receiving part 26 and the first receiving surface 6 may be placed on the other half of the tray body 4. This is indicated for a cup 52 in FIG. 5 by broken lines.

Figure 6:
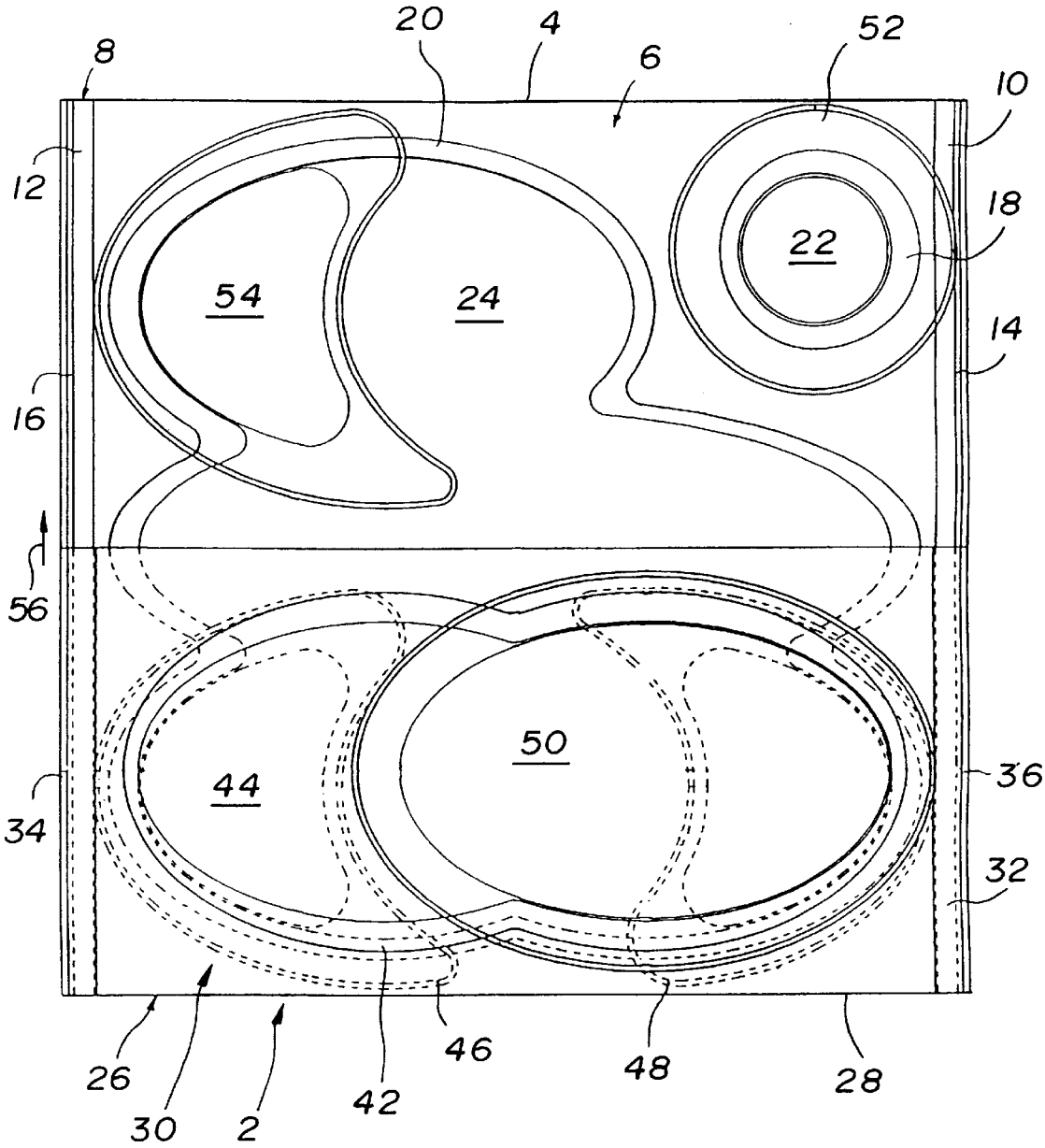
FIG. 6 shows a top plan view in FIG. 5 of the arrangement as shown in FIG. 5.

From FIG. 6 it can be seen that the receiving part 26 is disposed over one half of the tray body 4. In this position the meal container 50 disposed on the second receiving surface 30 and a meal container 54 disposed on the first receiving surface 6 are accessible from above. To open the remaining meal containers 46 and 48 the user displaces the receiving part 26 in the direction of an arrow 56, so that it is disposed over the upper half of the tray body 4 in FIG. 6, so that the meal containers 46, 48 are then accessible from above. When the receiving part 26 is displaced the cup 52 may be placed on the second receiving surface 30 of the receiving part 26.

From FIG. 6 it can also be seen that the shaped portions 18, 20, 42 are constructed in such a manner that the standing surfaces limited by them are in each case adapted to the outer contour of parts of the base of the meal containers 46, 48, 50, 54 and also of the cup 52. In this manner the meal containers 46, 48, 50, 54 and the cup 52 are securely retained on the receiving surfaces 6, 30.

Figure 7:
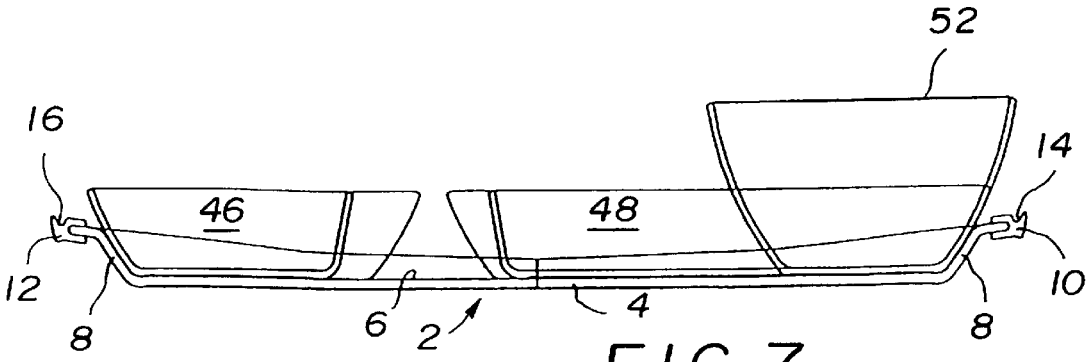
FIG. 7 shows the tray shown in FIG. 1 with meal containers placed thereon, but without the receiving part.

The tray 2 may also be used without the receiving part 26, as is represented in FIG. 7. Moreover the receiving part 26 may also be used without the tray body 4, as is explained in further detail below in the case of FIG. 21.

Figure 8:
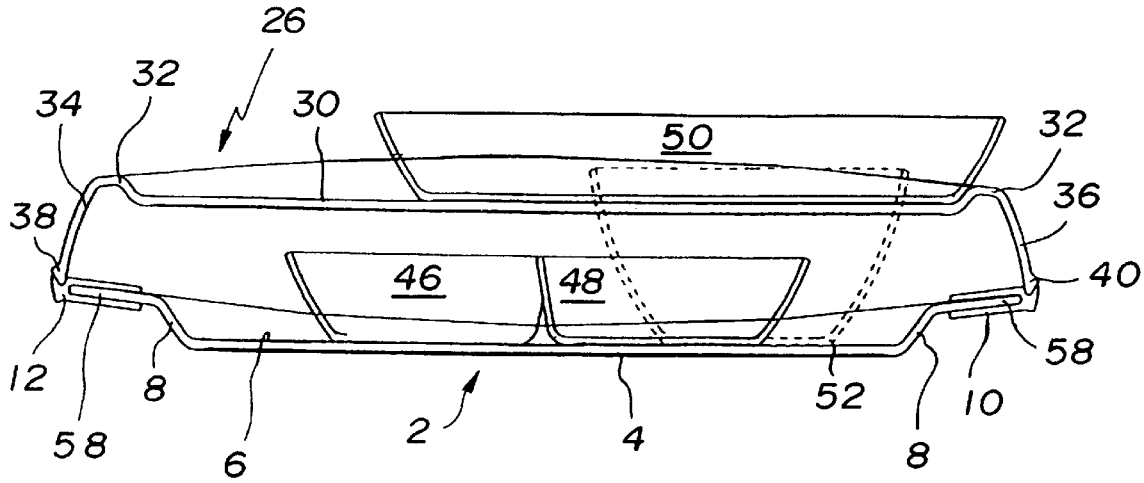
FIG. 8 shows in an identical representation to FIG. 5 a second exemplified embodiment of the tray specified by the invention.

FIG. 8 shows a second exemplified embodiment of the tray 2 specified by the invention with the receiving part 26 placed thereon and meal containers 46, 48, 50 situated on said part. This exemplified embodiment differs from that shown in FIGS. 1 to 5 in that the edge 8 comprises an extension 58 extending outwardly from the tray body 4, on which the handles 10, 12 are disposed. By virtue of the extension 58, in this exemplified embodiment the handles 10, 12 are constructed larger than in the exemplified embodiment shown in FIGS. 1 to 7, so that the handling of the tray 2 is further improved.

Figure 9:
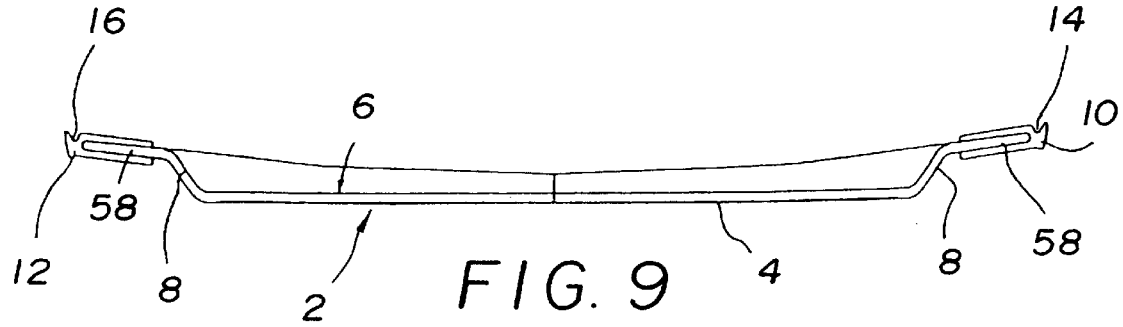
FIG. 9 shows in an identical representation to FIG. 1 the tray shown in FIG. 8 without the receiving part.

FIG. 9 shows the tray shown in FIG. 8 without the receiving part 26 and without the meal containers.

Figure 10:
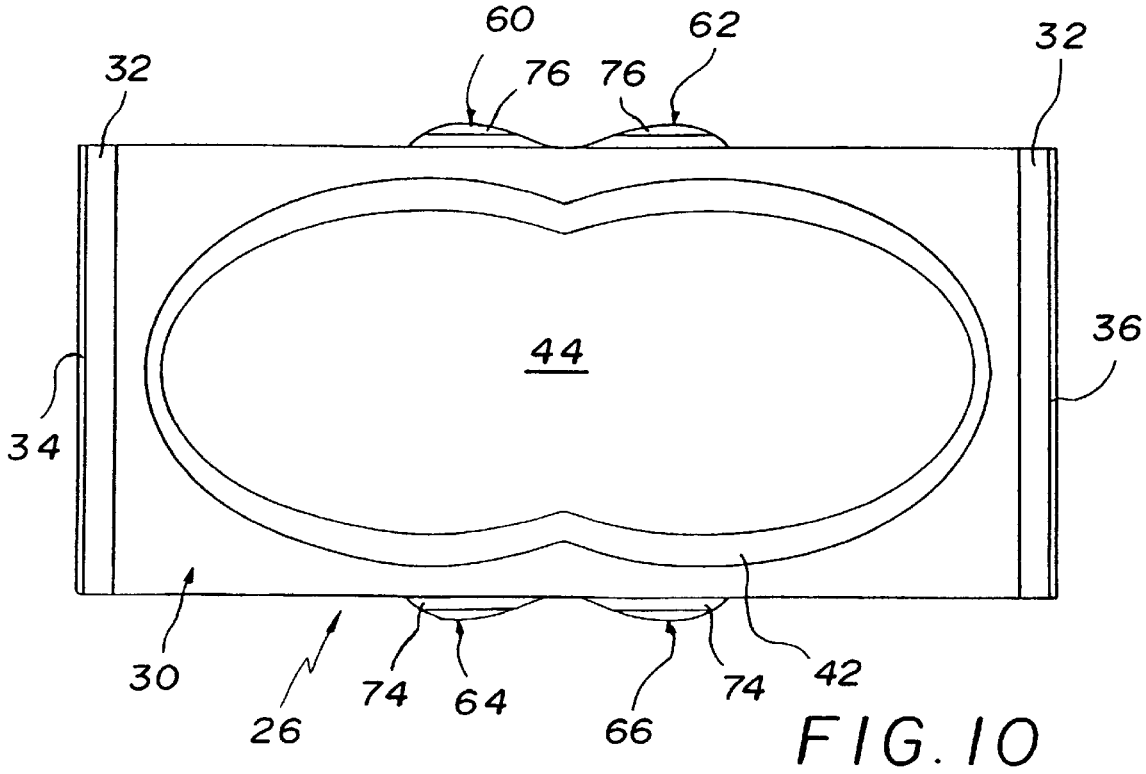
FIG. 10 shows a plan view of a second exemplified embodiment of the receiving part.

FIG. 10 shows a second exemplified embodiment of the receiving part 26, which differs from the first exemplified embodiment shown in FIG. 4 in that the receiving part 26 is provided on one transverse side with first connecting elements 60, 62, which in this exemplified embodiment are disposed in pairs, and on the opposite transverse side with second connecting elements 64, 66, which in this exemplified embodiment are also provided in pairs. The first connecting elements 60, 62 and the second connecting elements 64, 66 form connection means for the detachable connection of the tray 2 with adjacent tray not represented in FIG. 10, for example if the trays are placed next to one another on a trolley. The connecting means are explained in further detail below.

Figure 11:
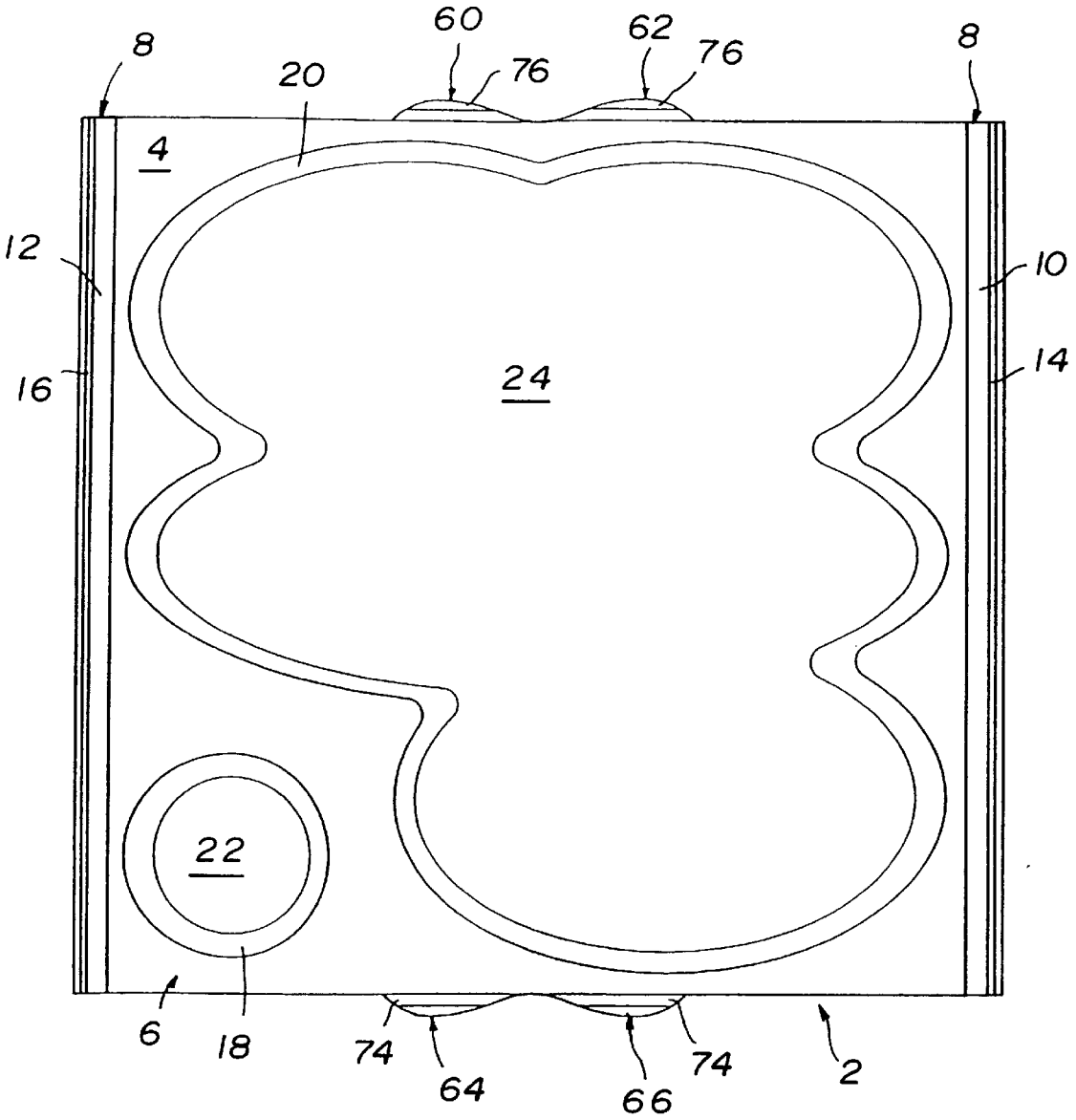
FIG. 11 shows a plan view of a third exemplified embodiment of the tray specified by the invention without the receiving part.

FIG. 11 shows a plan view of a tray body 4 of a third exemplified embodiment of the tray 2 specified by the invention. This exemplified embodiment differs from the exemplified embodiment shown in FIG. 2 by the fact that in this exemplified embodiment on one transverse side of the tray first connecting elements 60, 62 arranged in pairs are provided and on the opposite side second connecting elements 64, 66 also arranged in pairs are provided.

Figure 12:
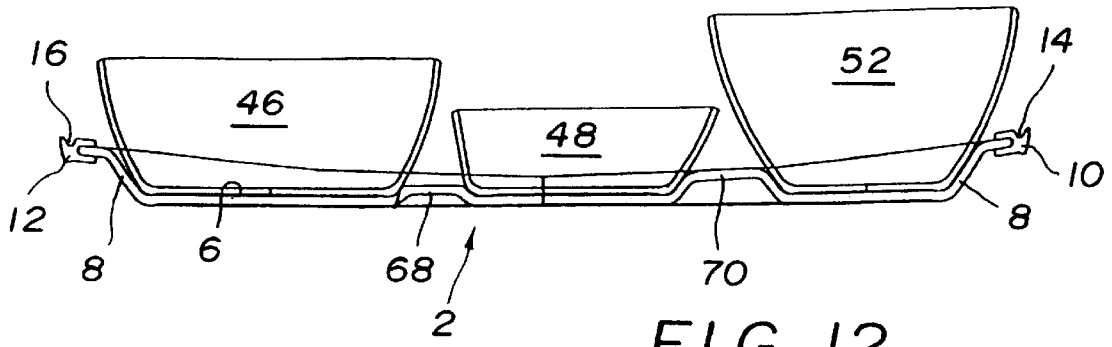
FIG. 12 shows the tray shown in FIG. 11 in a partially sectional side view with meal containers placed thereon.

FIG. 12 represents the tray shown in FIG. 11 in a partially sectional side view. It can be seen that the shaped portions 18, 20 of the first receiving surface 6 which limit the standing surfaces 22, 24 are formed by raised portions 68, 70. However the shaped portions 18, 20 may be formed by recesses, as is described in more detail above.

Figure 13:
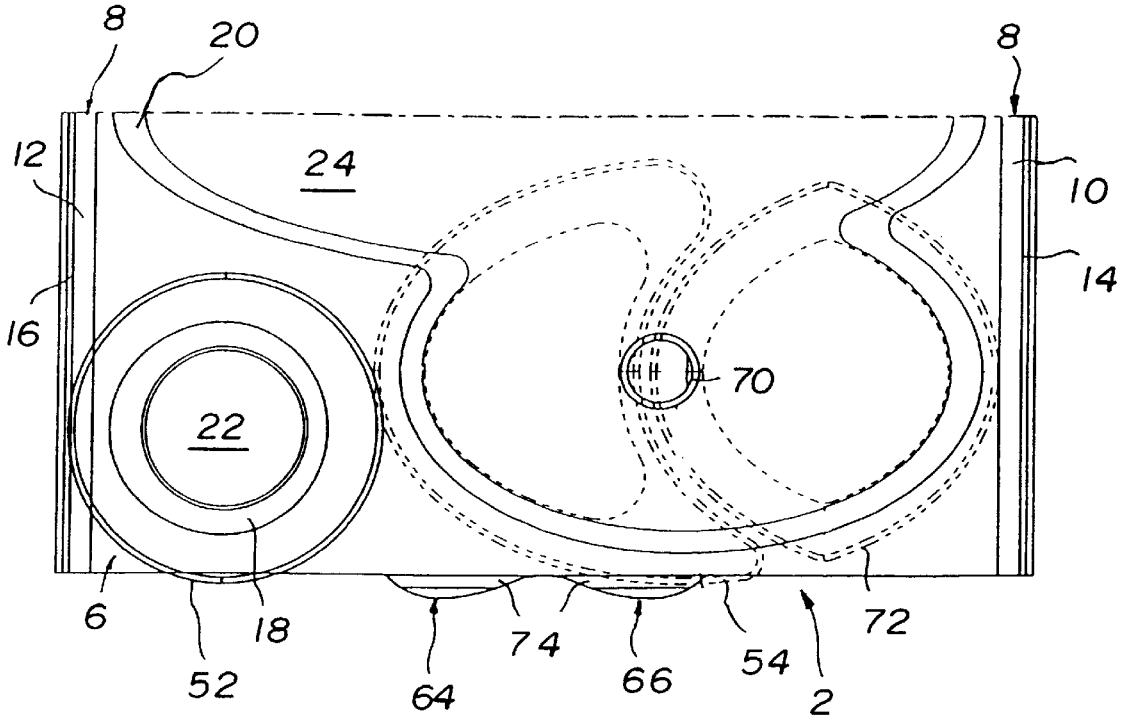
FIG. 13 shows the lower half of the tray as shown in FIG. 11 with meal containers seated thereon.

FIG. 13 shows a view top plan view of the lower half of the tray 2 in FIG. 11 as shown in FIG. 11, in which case a container 54, a cup 52 and a further meal container 72 are situated on the tray.

Figure 14:
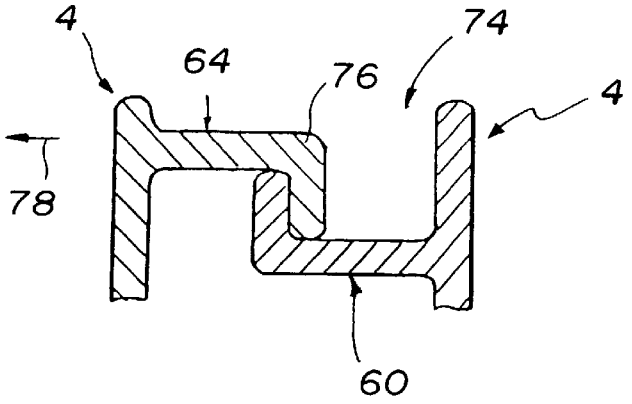
FIG. 14 shows a diagrammatical sectional view of the interconnected connecting elements of adjacent trays disposed next to one another.

FIG. 14 shows in a diagrammatical sectional view a first connecting element 60 of the tray body 4, which is connected to a second connecting element 64 of a tray which is not represented in the drawings and is adjacent to the tray 2.

The first connecting element 60 comprises a groove 74 extending substantially parallel to the side of the tray and open at the top, while the second connecting element 64 comprises a projection 76, with which the second connecting element 64 engages with form fit in the groove 74 of the first connecting element 60 of the adjacent tray. When the tray 2 is pulled in the direction of an arrow 79, for example when withdrawing the tray 2 from a trolley, the tray 2 entrains the adjacent tray in the direction of the arrow 79 by the form-fit connection of the connecting elements 60, 64. When the tray 2 is removed from the trolley, the second connecting element 64 of the tray 2 can be unhooked from the first connecting element 60 of the adjacent tray.

In this manner the handling of the tray 2 specified by the invention is improved, especially if several trays 2 specified by the invention are contained in a trolley.

The connecting elements 60, 62, 64, 66 may be provided on the tray body 4 and/or on the receiving part 26.

Figure 15:
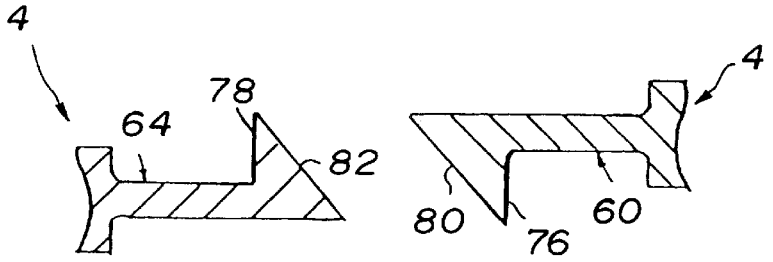
FIG. 15 shows a diagrammatical sectional view of a further embodiment of connecting elements.

FIG. 15 shows a further exemplified embodiment of connecting elements 60, 64, which are disposed at opposite sides of the tray body 4. In this exemplified embodiment the free end of the first connecting element 60 is constructed as a downwardly pointing hook 76 and the free end of the second connecting element 64 as an upwardly pointing hook 78. At their ends faced away from the tray body 4 the hooks 76, 78 in each case comprise a bevelled edge 80, 82, which in each case slopes towards the tray body 4. To connect the first connecting element 60 of the tray 2 to a second connecting element 64 of an adjacent tray, the tray 2 is displaced towards the adjacent tray, as illustrated by an arrow 79 in FIG. 15. In this case the hook 76 of the first connecting element 60 slides by its bevelled edge 80 up to the bevelled edge 82 of the second connecting element 64 of the adjacent tray and finally hooks onto the hook 76, so that the trays are connected to one another and when one of the trays is moved in the direction of the arrow 78 or in the opposite direction to the arrow 79 the respectively adjacent tray is entrained and in this manner a series connection is formed between the trays. The connecting elements 60, 64 can be added to the tray 2 or formed in one piece therewith.

Figure 16:
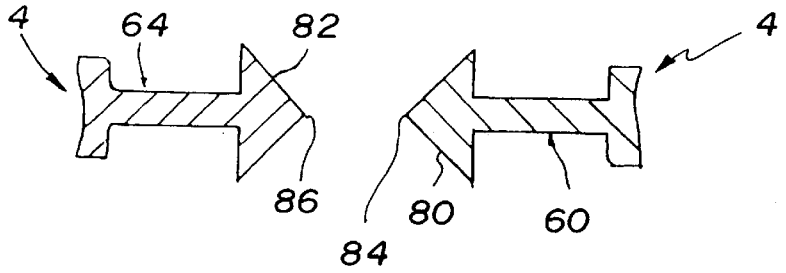
FIG. 16 shows in an identical representation to FIG. 15 a further embodiment of connecting elements.

Represented in FIG. 16 is a further exemplified embodiment of connecting elements 60, 64, in which the first connecting element 60 and the second connecting element 64 have an identical construction with respect to their shape. The connecting elements 60, 64 comprise a substantially arrow-shaped cross section, the arrow tips 84 and 86 respectively of which point away from the tray body 4. The connection of two adjacent trays 2 to one another is performed in this exemplified embodiment in the manner described above with reference to FIG. 15.

In comparison with the exemplified embodiment shown in FIG. 15, the exemplified embodiment shown in FIG. 16 however has the advantage that, by virtue of t he symmetric al design of the connecting elements 60, 64, the first connecting elements 60 of the tray 2 can be connected both with the first connecting elements 60 and also with the second connecting elements 64 of an adjacent tray, whereas in contrast in the exemplified embodiment shown in FIG. 15, with the connecting elements 60, 64 having a different design, a connection of two adjacent trays 2 is only possible if in each case a first connecting element 60 of a tray 2 is opposite a second connecting element 64 of an adjacent tray.

Figure 17:
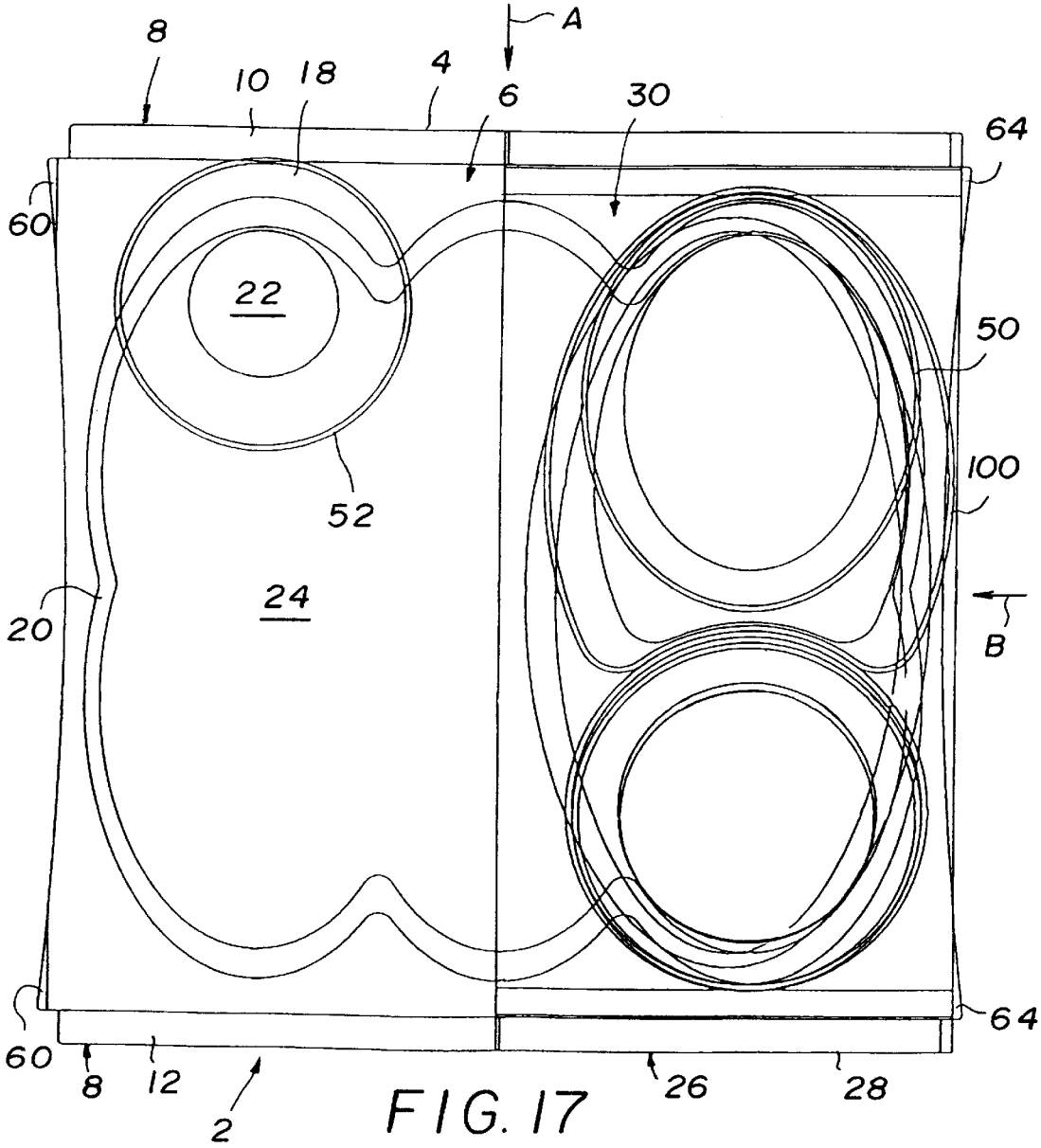
FIG. 17 shows in an identical representation to FIG. 6 a fourth exemplified embodiment of the tray specified by the invention with connecting elements shown in FIG. 16.

FIG. 17 shows a plan view of a tray 4 with the connecting elements shown in FIG. 16.

It can be seen that the connecting elements 60, 64 are disposed on opposite sides of the tray body 4 and in pairs in each case. However it is basically sufficient if in each case just one connecting element 60, 64 is provided for each side of the tray. Moreover it can be seen that the cross section of the connecting elements 60, 64 increases outwardly along the side of the tray.

Figure 18:
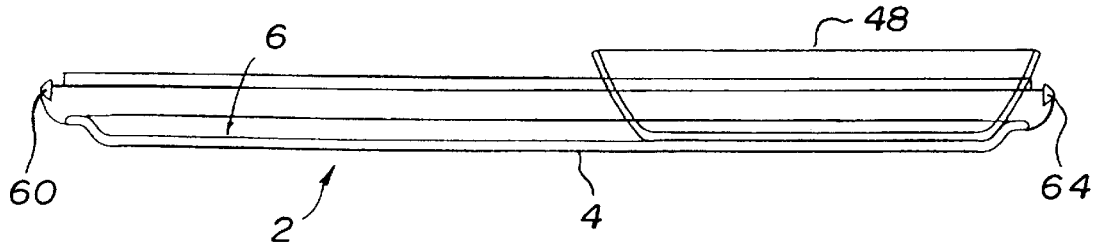
FIG. 18 shows a view in the direction of an arrow A in FIG. 17 of the tray shown in FIG. 17 without the receiving part.

FIG. 18 shows a view from underneath in FIG. 17 of the tray shown in FIG. 17 without receiving part 26, wherein the arrow-shaped cross section of the connecting elements 60, 64 can be seen.

Figure 19:
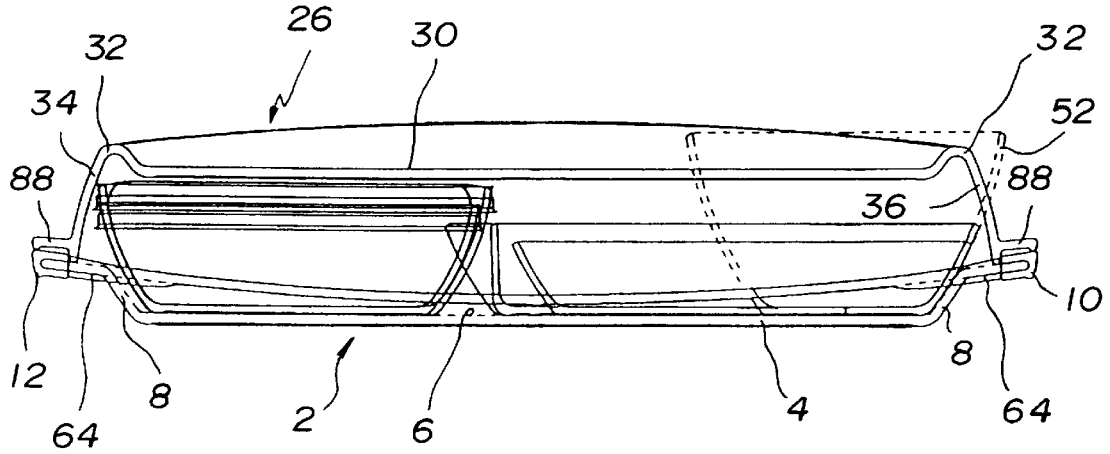
FIG. 19 shows a view in the direction of an arrow B in FIG. 17 of the tray shown in FIG. 17 with the receiving part placed thereon.

FIG. 19 shows a view from the right in FIG. 17, wherein it can be seen that the cross section of the second connecting elements 64 is enlarged upwardly and downwardly along the side of the tray.

Figure 20:
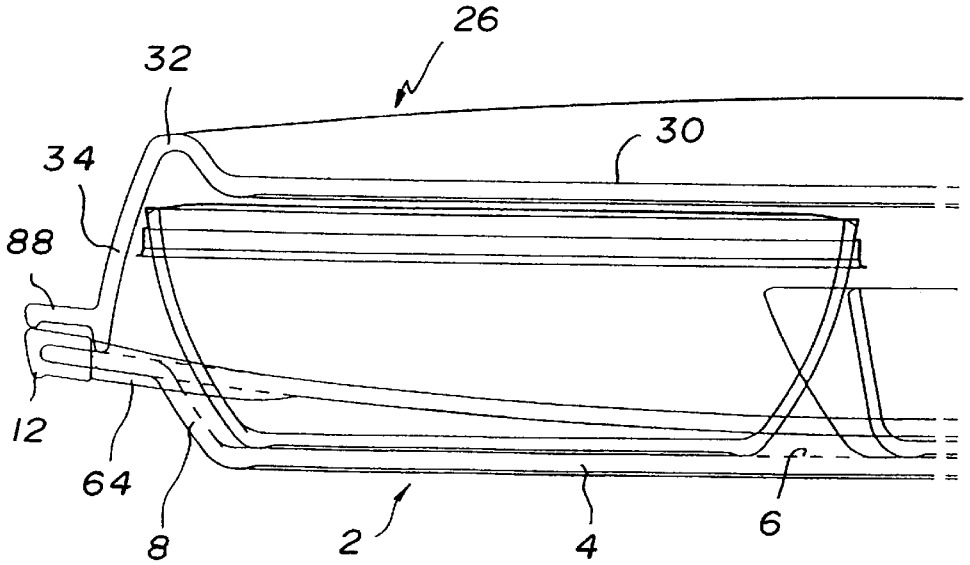
FIG. 20 shows in an enlarged representation a detail in FIG. 19 in the region of the connecting element.

FIG. 20 shows a detail from FIG. 19 in the region of the connecting element 64 on the left in FIG. 19. It serves to illustrate the design of the connecting element 64. Moreover in FIG. 20 it can be clearly seen that the receiving part 26 in this exemplified embodiment comprises an edge part 34 which in the region of its free end comprises an outwardly pointing edge region 88. Moreover in this exemplified embodiment the edge part 34 of the receiving part 26 is guided by its end faced towards the tray body 4 not in grooves formed on the upper side of the handles 10, 12, but on an edge of the handle 12 extending in the displacement direction. The edge part 36 with its end faced towards the tray body 4 is guided in a corresponding manner on an edge of the handle 10.

A stop for limiting the displacement of the receiving part 26 in relation to the tray body 4 is formed by the fact that the second connecting element 64 extends upwardly in the region of the edge of the handle 12.

Figure 21:
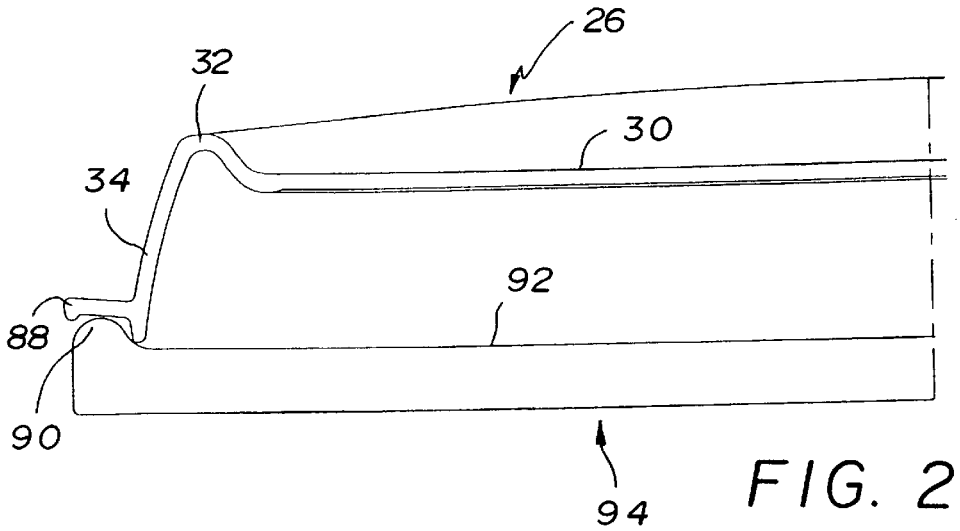
FIG. 21 shows the receiving part shown in FIGS. 19 and 20 without the tray body.

The receiving part 26 may also be used without the tray body 4, as represented in FIG. 21. The receiving part 26 may for example be supported by its edge regions 88 of its edge parts 34, 36 on an edge bead 90 of a table top 92 of a passenger table 94 in an aeroplane. The receiving part 26 is then securely retained on the passenger table 94.

Figure 22:
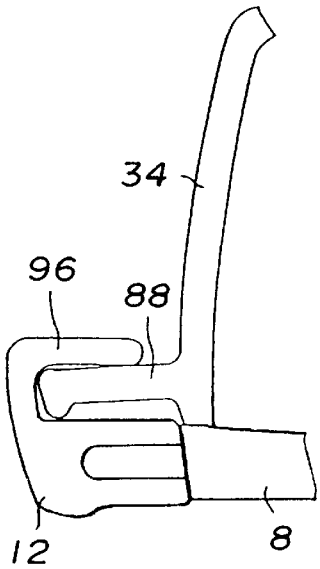
FIG. 22 shows a first exemplified embodiment of clamping means for connecting the tray body to the receiving part by clamping.

To prevent the receiving part 26 sliding off the tray body 4, clamping means for connecting the receiving part 26 to the tray body 4 by clamping may be provided. FIG. 22 shows a first exemplified embodiment of such clamping means, in which the clamping means are formed by a clamp 96 moulded on the handle 12, which in the clamping position engages over the edge region 88 of the edge part 34 of the receiving part 26. In this manner the receiving part 26 is reliably prevented from sliding off the tray body 4, with a displacement of the receiving part 26 in the displacement direction, i.e. perpendicular to the drawing plane in FIG. 22, also being possible.

Figure 23:
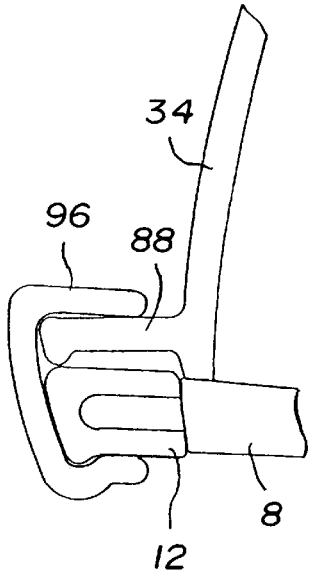
FIG. 23 shows a second exemplified embodiment of clamping means for connecting the tray body to the receiving part by clamping.

Represented in FIG. 23 is a further exemplified embodiment of the clamping means, in which the clamp 96 is constructed as a separate part and in the clamping position engages in clamping fashion over the edge 8 of the tray body 4 or the handle 12 and the edge region 88 of the edge part 34 of the receiving part 26. The clamp 96 may be made from metal, for example.

Figure 24:
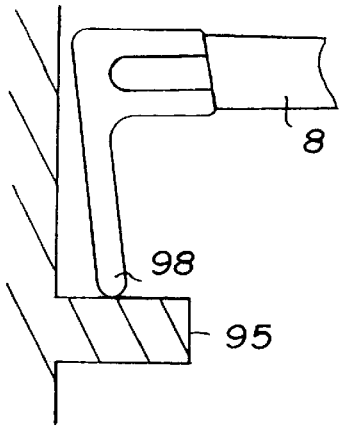
FIG. 24 shows a detail of a further exemplified embodiment of the tray specified by the invention contained in a trolley in the region of the edge of the tray body and FIG. 25 shows a plan view of a part of the first receiving surface of a further exemplified embodiment of the tray specified by the invention.

Represented in FIG. 24 is a detail in the region of the edge 8 of the tray body 4 of a further exemplified embodiment of the tray body 2. In this exemplified embodiment the tray body 4 in the region of its edge 8 is provided with support parts 98, which project over the under side of the tray body 4. The tray body 4 is supported by these support parts 24 on a rail 95 of a slide-in compartment 97 of a trolley, so that the tray body 4 is disposed higher in relation to the rail 95 than would be the case if the tray were supported directly by the underside of the handle 12 on the guide rail 95. This may be necessary by virtue of the construction of the slide-in compartments of some trolleys. Depending on how the slide-in compartments of the respective trolley are constructed, the tray body 4 therefore comprises either support parts 98 or is supported directly by the handles or another part of the tray body in the slide-in compartment of the trolley.

Figure 25:
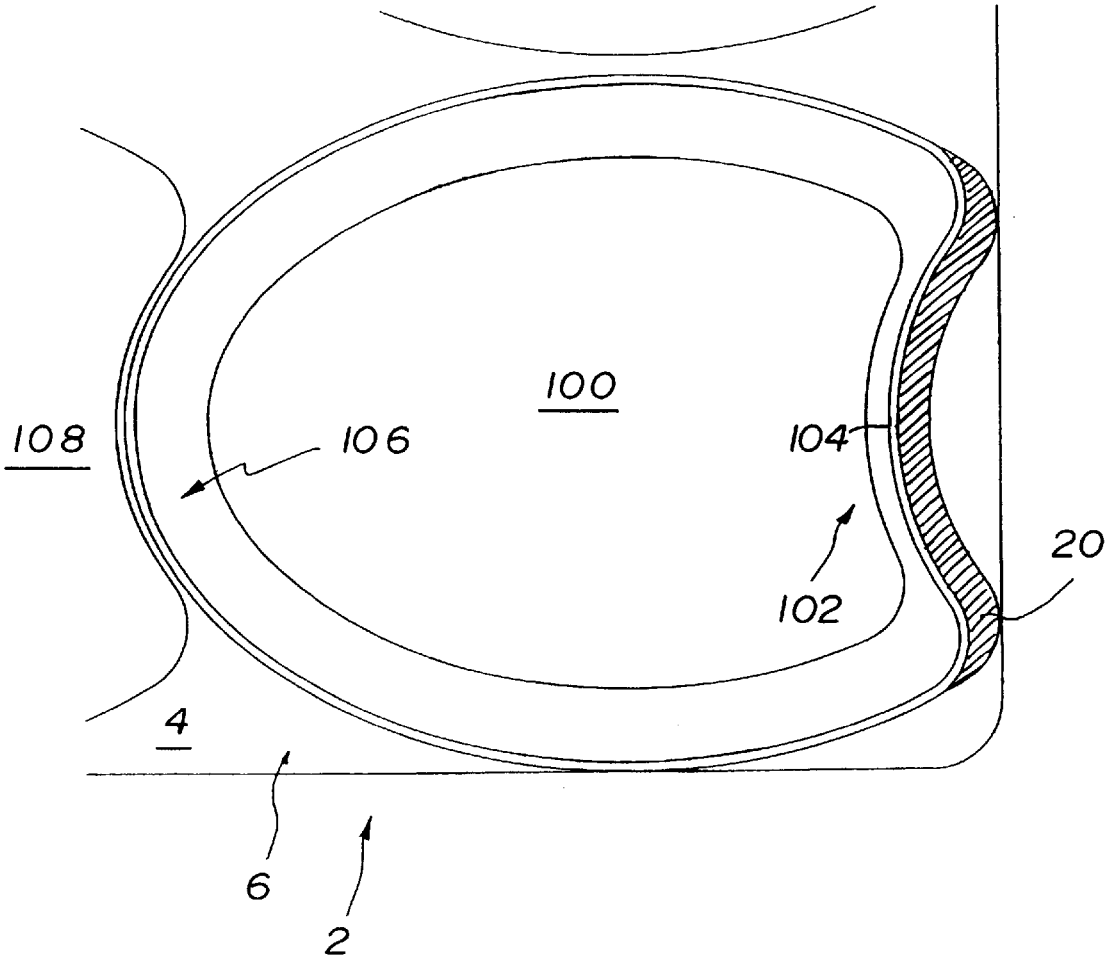

FIG. 25 shows a plan view of a tray body 4 of a further exemplified embodiment of the tray 2 specified by the invention. The first receiving surface 6 comprises a shaped portion 20, which is formed by a depression and limits a standing surface 24 which is adapted to the outer contour of the base of a meal container 100. A narrow side 102 of the meal container 100 comprises a recess 104, which is shaped to complement the opposite narrow side 106 of the meal container 100 in such a manner that when several similar meal containers are situated on a tray 2, the meal container 100 with its narrow edge 106 abuts the recess 104 of an adjacent meal container 108 with form fit. By the form-fit abutment of the meal container 100 against the meal container 8 in conjunction with the shaped portion 20, the retention of the meal containers 100, 108 on the tray 2 is improved, so that even when the tray 2 is tilted the meal containers 100, 108 do not slide in FIG. 6

The area of the tray body may correspond, for example, to roughly ⅔ the area of a conventional tray. Then four such trays specified by the invention may be contained one behind the other in a slide-in compartment of a conventional trolley. The area of the receiving part 26 may, for example, correspond to roughly ⅓ the area of a conventional tray. In this case six such receiving parts may be used in a slide-in compartment of a conventional trolley.

What is claimed is:

1. A food tray particularly suited for use on board aircrafts, vehicles and other types of transportation, the food tray comprising:

a) a tray body;

b) a first food receiving surface disposed on the tray body;

c) a receiving part being locatable above and spaced apart from the first food receiving surface;

d) the receiving part having a top side located on a side facing away from the tray body;

e) the receiving part including an edge from which at opposite sides of the receiving part edge parts extend, which edge parts protrude over the underside of the receiving part and with which edge parts the receiving part is supported on the tray body;

f) a second food receiving surface disposed on the top side of the receiving part;

g) the receiving part being movable on the tray body; and h) the receiving part being movable relative to the tray body so that the second food receiving surface is movable substantially parallel to the first food receiving surface, in use.

2. A tray according to claim 1, wherein:

a) on opposite sides the tray body is provided with grooves extending in a direction of substantially parallel displacement of the receiving part; and b) the edge parts engage in the grooves by ends shaped substantially to complement the grooves.

3. A tray according to claim 2, wherein:

a) the edge parts in the displacement direction extend substantially over the entire extent of the receiving part.

4. A tray according to claim 2, wherein:

a) on at least two opposite sides the tray body is provided with handles, on the upper side of which handles the grooves are formed.

5. A tray according to claim 1, wherein:

a) the second receiving surface formed on the receiving part is smaller than the first receiving surface.

6. A tray according to claim 1, wherein:

a) the second receiving surface is roughly half the size of the first receiving surface.

7. A tray according to claim 1, wherein:

a) the tray body includes an edge extending upwardly from the first food receiving surface.

8. A tray according to claim 1, wherein:

a) at least one of the first food receiving surface and the second food receiving surface is provided with shaped portions, which shaped portions define standing surfaces, configured to at least partially to match the outer contour of the base of a meal container to be seated on the tray.

9. A tray according to claim 1, wherein:

a) at least one of the tray body and the receiving part is made from plastic.

10. A tray according to claim 1, wherein:

a) the tray comprises a connector for the detachable connection of the tray to at least one adjacent tray.

11. A tray according to claim 2, wherein:

a) the grooves in the region of their ends comprise a stop to limit the displacement of the receiving part relative to the tray body.

12. A tray according to claim 11, wherein:

a) the stop is formed by a connecting element.

13. A tray according to claim 1, wherein:

a) the edge parts of the receiving part comprise an outwardly pointing edge region in the region of their free ends.

14. A tray according to claim 1, wherein:

a) a clamp is provided for the connection of the receiving part to the tray body.

15. A tray according to claim 14, wherein:

a) the clamp is formed by at least one clamp, which one clamp in the clamping position clamps the edge of the tray body and the edge region of the edge parts of the receiving part.

16. A tray according to claim 15, wherein:

a) the at least one clamp is molded on at least one of the edge of the tray body and the edge region of the edge parts of the receiving part.

17. A tray according to claim 1, wherein:

a) support parts are provided on a region of the tray body adjacent the edge, free ends of which support parts project over an underside of the tray body or are substantially flush with the underside of the tray body.

18. A tray according to claim 1, wherein:

a) the edge parts of the receiving part are guided along edges which are defined on at least one of the tray body and a part connected therewith.

19. A tray according to claim 1, wherein:

a) the receiving part is about half the size of the tray body.

20. A tray according to claim 16, wherein:

a) the at least one clamp is molded on at least one of the edge of the tray body and the edge region of the edge parts of the receiving part.

21. A food tray particularly suited for use on board aircrafts, vehicles and other types of transportation, the food tray comprising:

a) a tray body;

b) a first food receiving surface disposed on the tray body;

c) a receiving part being locatable above and spaced apart from the first food receiving surface;

d) the receiving part having a top side located on a side facing away from the tray body;

e) the tray including a connector for the detachable connection of the tray to at least one adjacent tray;

f) a second food receiving surface disposed on the top side of the receiving part;

g) the receiving part being movable on the tray body; and h) the receiving part being movable relative to the tray body so that the second food receiving surface is movable substantially parallel to the first food receiving surface, in use.

22. A tray according to claim 21, wherein:

a) the connector includes a first connecting element disposed laterally on the tray and which connector comprises a groove extending substantially parallel to the side of the tray, and includes a second connecting element disposed at the side of the tray lying opposite the first connecting element and which comprises a projection for form-fit engagement in a groove of a first connecting element of an adjacent tray, in use.

23. A tray according to claim 21, wherein:

a) the connector is disposed on at least one of the tray body and the receiving part.

24. A tray according to claim 22, wherein:

a) free ends of the connecting elements are constructed as hooks, with the hook of the first connecting element pointing downwards and the hook of the second connecting element pointing upwards in such a manner that the first connecting element of the tray body can be hooked onto the second connecting element of an adjacent tray, in use.

25. A tray according to claim 22, wherein:

a) at least one of the first connecting element and the second connecting element comprises a substantially arrow-shaped cross section, an arrow point of which points away from the tray body.

26. A tray according to claim 22, wherein:

a) a cross sect ion of at least one of the connecting elements has an extent which increases outwardly along the side of the tray.

27. A tray according to claim 22, wherein:

a) the at least one connecting element is molded on at least one of the tray body and the receiving part.

28. A food tray particularly suited for use on board aircraft, vehicles and other types of transportation, the food tray comprising:

a) a tray body;

b) a first food receiving surface disposed on the tray body;

c) a receiving part being locatable above and spaced apart from the first food receiving surface;

d) the receiving part having a top side located on a side facing away from the tray body;

e) a clamp provided for the connection of the receiving part to the tray body;

f) a second food receiving surface disposed on the top side of the receiving part;

g) the receiving part being movable on the tray body; and h) the receiving part being movable relative to the tray body so that the second food receiving surface is movable substantially parallel to the first food receiving surface, in use.

29. A tray according to claim 28, wherein:

a) the clamp is formed by at least one clamp, which one clamp in the clamping position clamps the edge of the tray body and the edge region of the edge parts of the receiving part.

* * * * *